US009499977B2

(12) United States Patent
Strand et al.

(10) Patent No.: US 9,499,977 B2
(45) Date of Patent: Nov. 22, 2016

(54) MOTORIZED ACOUSTICAL BANNER

(71) Applicant: Wenger Corporation, Owatonna, MN (US)

(72) Inventors: Terry Strand, Owatonna, MN (US); Dann Rypka, Medford, MN (US); Aaron Harris, Owatonna, MN (US); Denny Meyer, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

(21) Appl. No.: 14/833,682

(22) Filed: Aug. 24, 2015

(65) Prior Publication Data

US 2016/0130806 A1 May 12, 2016

Related U.S. Application Data

(60) Provisional application No. 62/077,407, filed on Nov. 10, 2014.

(51) Int. Cl.
*E04B 1/99* (2006.01)
*G10K 11/16* (2006.01)

(52) U.S. Cl.
CPC ..... *E04B 1/994* (2013.01); *G10K 11/16* (2013.01)

(58) Field of Classification Search
CPC ..... E04B 1/994
USPC ..... 181/30, 287; 160/243
See application file for complete search history.

(56) References Cited

U.S. PATENT DOCUMENTS 3,049,190 A 8/1962 Coffman
3,411,605 A 11/1968 Coffman et al.
3,590,354 A 6/1971 Shiflet
3,991,538 A 11/1976 Finn et al.
4,226,299 A 10/1980 Hansen
4,605,088 A 8/1986 Sickels
4,682,670 A 7/1987 Lerner et al.
5,035,298 A 7/1991 Noxon
5,896,710 A 4/1999 Hoyle
(Continued)

FOREIGN PATENT DOCUMENTS

EP 1512829 3/2005

OTHER PUBLICATIONS

Barron, M. "Auditorium Acoustics and Architectural Design", 2nd Edition, Taylor & Francis, 2009, copy available at samples.sainsburysebooks.co.uk/9781135219260_sample_546156.pdf. Accessed Apr. 18, 2016.

Daktronics, "Daktronics Pro Series Controller—Automated Acoustic Hoists". Published at least as early as Aug. 24, 2015. Available at media.wix.com/ugd/bdb2a8_4db60dbacff54867beaf3609d63d5a40.doc?dn=Daktronics%20Pro%20Series%20Acoustical%20Banner%20Hoist%20Architectural %20Specifications.doc, Accessed Apr. 18, 2016.

Theatre Project Consultants, "Variable Acoustic Controls", The Music Center at Strathmore, published 2005. Available at www.jrclancy.com/Downloads/strathmoresingles.pdf, Accessed Apr. 18, 2016.

*Primary Examiner* — Jeremy Luks
(74) *Attorney, Agent, or Firm* — Patterson Thuente Pedersen, P.A.

(57) ABSTRACT

A motorized acoustical banner that functions as a variable acoustic absorber is disclosed. The motorized acoustical banner includes a multi-panel fabric banner that allows for adjustable spacing between the layers of fabric as well as between the banner and the wall to which it is mounted. The motorized acoustical banner further includes a drum roller configuration that allows for easily and quickly changing the banner fabric without having to disassemble the entire device. The motorized acoustical banner also includes a tubular motor that can be removed from the device without removing the entire drum.

20 Claims, 18 Drawing Sheets

(56) References Cited

U.S. PATENT DOCUMENTS

| | | | | |
|---|---|---|---|---|
| 6,530,451 | B2 | 3/2003 | Noselli | |
| 6,782,971 | B2 | 8/2004 | Dutton et al. | |
| 7,100,862 | B2 | 9/2006 | Skarzenski et al. | |
| 7,438,115 | B2 | 10/2008 | Bohlen | |
| 7,905,323 | B2 * | 3/2011 | Larsen | G10K 11/172 181/286 |
| 2013/0037646 | A1 | 2/2013 | Ohl et al. | |

* cited by examiner

FIG. 25A

| SPACING OPTIONS (INCHES) | | | IDLER ROLLER LOCATION | |
|---|---|---|---|---|
| WALL TO FRONT FABRIC | BETWEEN FABRIC | WALL TO REAR FABRIC | FRONT | REAR |
| 9.00 | 3.00 | 6.00 | 106a | 110a |
| | 4.00 | 5.00 | 106a | 110b |
| | 5.00 | 4.00 | 106a | 110c |
| 8.00 | 3.00 | 5.00 | 106b | 110b |
| | 4.00 | 4.00 | 106b | 110c |
| 7.00 | 3.00 | 4.00 | 106c | 110c |

| SPACING OPTIONS (INCHES) | | | IDLER ROLLER LOCATION | | |
|---|---|---|---|---|---|
| WALL TO FRONT FABRIC | BETWEEN FABRIC | WALL TO REAR FABRIC | FRONT | CENTER | REAR |
| 16.00 | 6.00 | 10.00 | 106a | 111a | 110b |
| | 7.00 | 9.00 | 106a | 111a | 110c |
| | 8.00 | 8.00 | 106a | 111a | 110d |
| 15.00 | 4.00 | 11.00 | 106b | 111b | 110a |
| | 5.00 | 10.00 | 106b | 111b | 110b |
| | 6.00 | 9.00 | 106b | 111b | 110c |
| | 7.00 | 8.00 | 106b | 111b | 110d |
| 14.00 | 4.00 | 10.00 | 106c | 111b | 110b |
| | 5.00 | 9.00 | 106c | 111c | 110c |
| | 6.00 | 8.00 | 106c | 111c | 110d |
| 13.00 | 4.00 | 9.00 | 106d | 111d | 110c |
| | 5.00 | 8.00 | 106d | 111d | 110d |
| 12.00 | 4.00 | 8.00 | 106e | 111e | 110d |

FIG. 25B

MOTORIZED ACOUSTICAL BANNER

RELATED APPLICATIONS

This application claims the benefit of U.S. Provisional Application No. 62/077,407, filed Nov. 10, 2014, which is hereby fully incorporated herein by reference.

FIELD OF THE INVENTION

The present invention relates to acoustical room treatments, and more specifically relates to a motorized acoustical banner that functions to selectively vary the acoustic properties of performance spaces, the method for production thereof, and a method of selectively varying the acoustical properties of a performance space.

BACKGROUND OF THE INVENTION

It is well known that rooms can produce distortional acoustic effects such as echoes, reverberations, amplified bass tones, and uneven volume distribution throughout the room. Systems for improving the sound quality of indoor rooms have been disclosed in U.S. Pat. Nos. 3,049,190; 3,411,605; 3,590,354; 4,226,299; 4,605,088; 4,682,670; 5,035,298; 5,896,710; 6,530,451; 6,782,971, all being incorporated herein by reference. Such prior systems generally employ large volume panels that attach to the walls or employ floor-standing structures, some of which are movable or adjustable nature. Such panels and related structures are usually of bulky, heavy and expensive construction, or difficult to install, or detract from the aesthetic appearance or floor space of the room. The prior art systems did not address the needs for performance areas such as college recital halls or school cafetorium areas where variable acoustics are often required. Moreover, past systems have not adequately addressed the problem that the same room or performance space is often used for different purposes that present different acoustic challenges. Wenger Corporation improved upon existing acoustic panels by developing a tunable acoustic panel that enables a rehearsal room to be satisfactorily used for both instrumental and choral rehearsal with a simple mechanical lever mechanism.

Another means of addressing the sound quality of indoor rooms include the use of a motorized acoustic banner roller system such as that manufactured by acouStaCorp LLC. These systems are known in the art as variable acoustic absorption banner (VAAB) systems. An example of a VAAB system is shown in U.S. Patent Application Publication US 2013/00376646A1, which is also incorporated herein by reference. One limitation of these prior art devices is that they frequently have misalignment issues when rolling or unrolling the banners, have a fixed distance between the banner and the wall to which they are mounted, and are difficult to maintain because changing the banner fabric is difficult and time-consuming.

A need exists, therefore, for an improved motorized acoustical banner.

SUMMARY OF THE INVENTION

In embodiments, a motorized acoustical banner that functions as a variable acoustic absorber is disclosed. The motorized acoustical banner includes a multi-panel fabric banner that allows for adjustable spacing between the layers of fabric as well as between the banner and the wall to which it is mounted. The motorized acoustical banner further includes a drum roller configuration that allows for easily and quickly changing the banner fabric without having to disassemble the entire device. The motorized acoustical banner also includes a tubular motor that can be removed from the device without removing the entire drum.

It is an object of the invention to provide a multi-panel banner. It is an object of the invention to provide a device that can provide a longer and wider motorized acoustic banner than allowed by the prior art, and that can accommodate several types of fabrics. It is another object of the invention to use a tubular motor that allows for removal of the motor without complete disassembly of the drum roll. It is also an object of the invention to provide a motorized acoustic banner that includes adjustable spacing from the mount wall as well as adjustable spacing between the layers of fabric. It is a further object of the invention to provide a design that allows a quick change of the fabric for replacement and/or maintenance. It is another object of the invention to provide a quick change drum roller with a channel for coupling to a banner. It is a further object of the invention to provide a banner having a novel horizontal seam stitching.

BRIEF DESCRIPTION OF THE DRAWINGS

The invention may be more completely understood in consideration of the following detailed description of various embodiments of the invention in connection with the accompanying drawings, in which:

FIG. 25A is a chart of idler roller positions for desired fabric spacing according to an embodiment of the present invention.

FIG. 25B is a chart of idler roller positions for desired fabric spacing according to another embodiment of the present invention.

Figure 1:
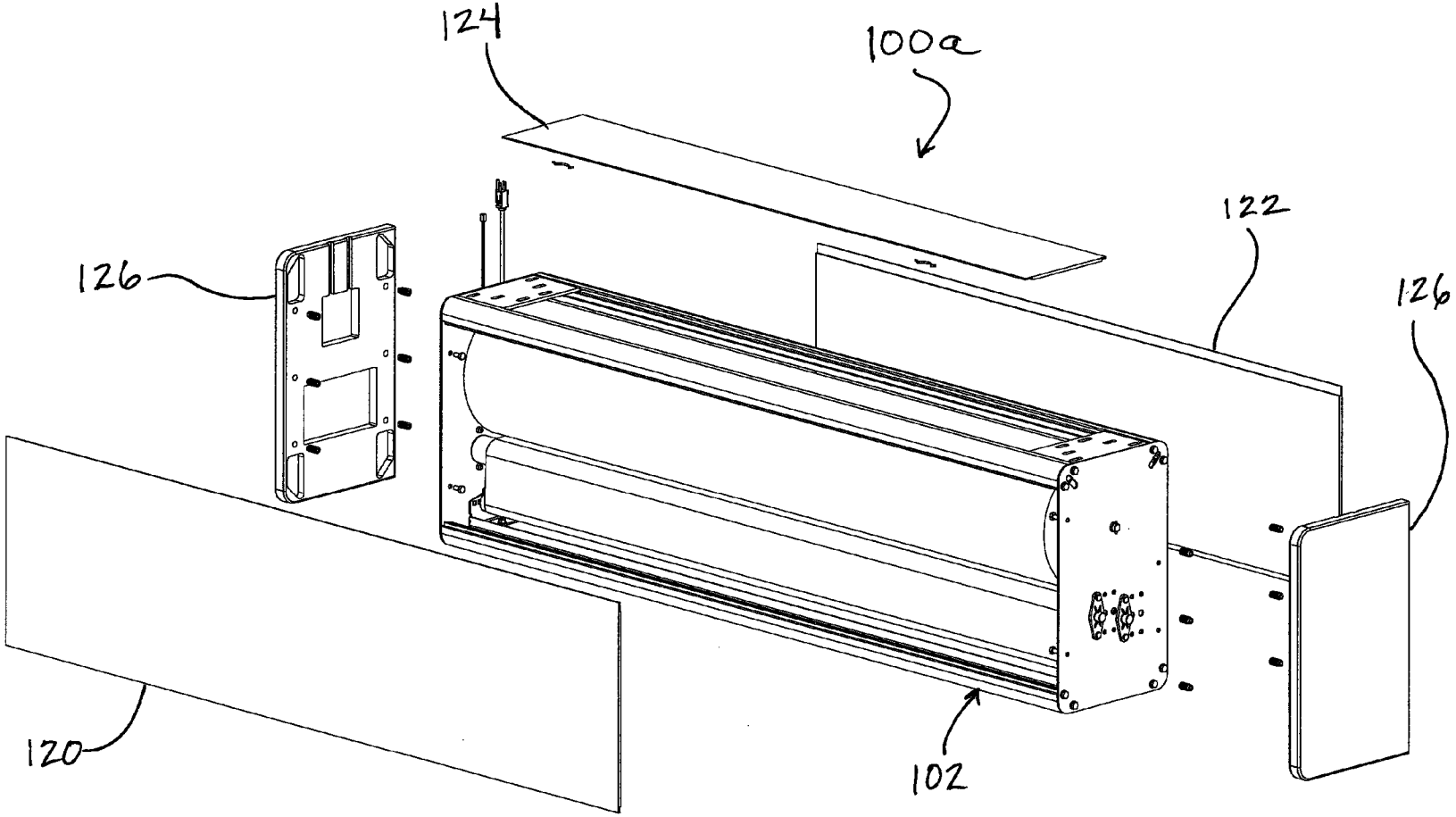
FIG. 1 is a partially exploded dimetric projection view of a motorized acoustical banner according to an embodiment of the invention.
Figure 2:
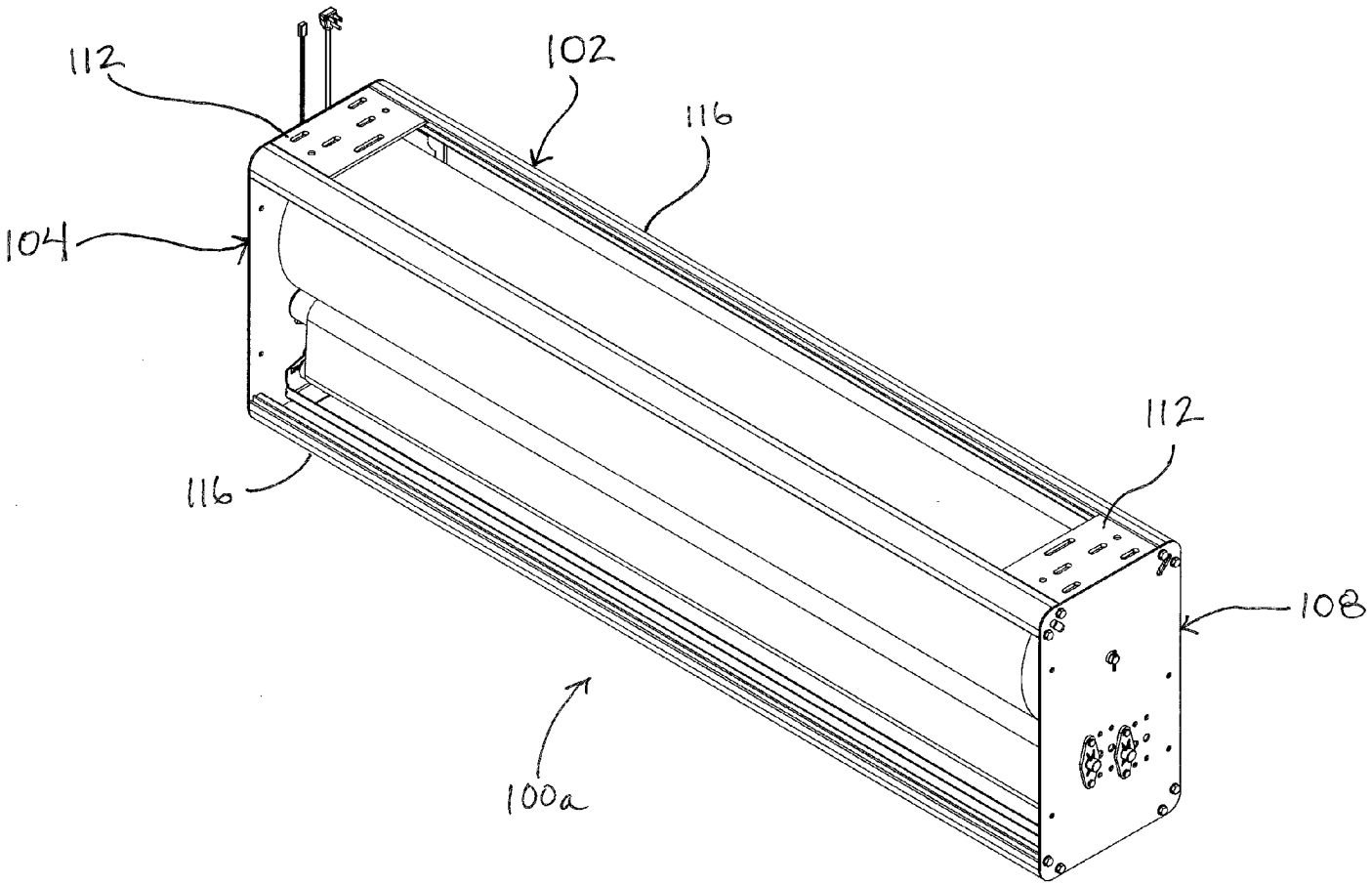
FIG. 2 is an isometric view of the motorized acoustical banner of FIG. 1.
Figure 3:
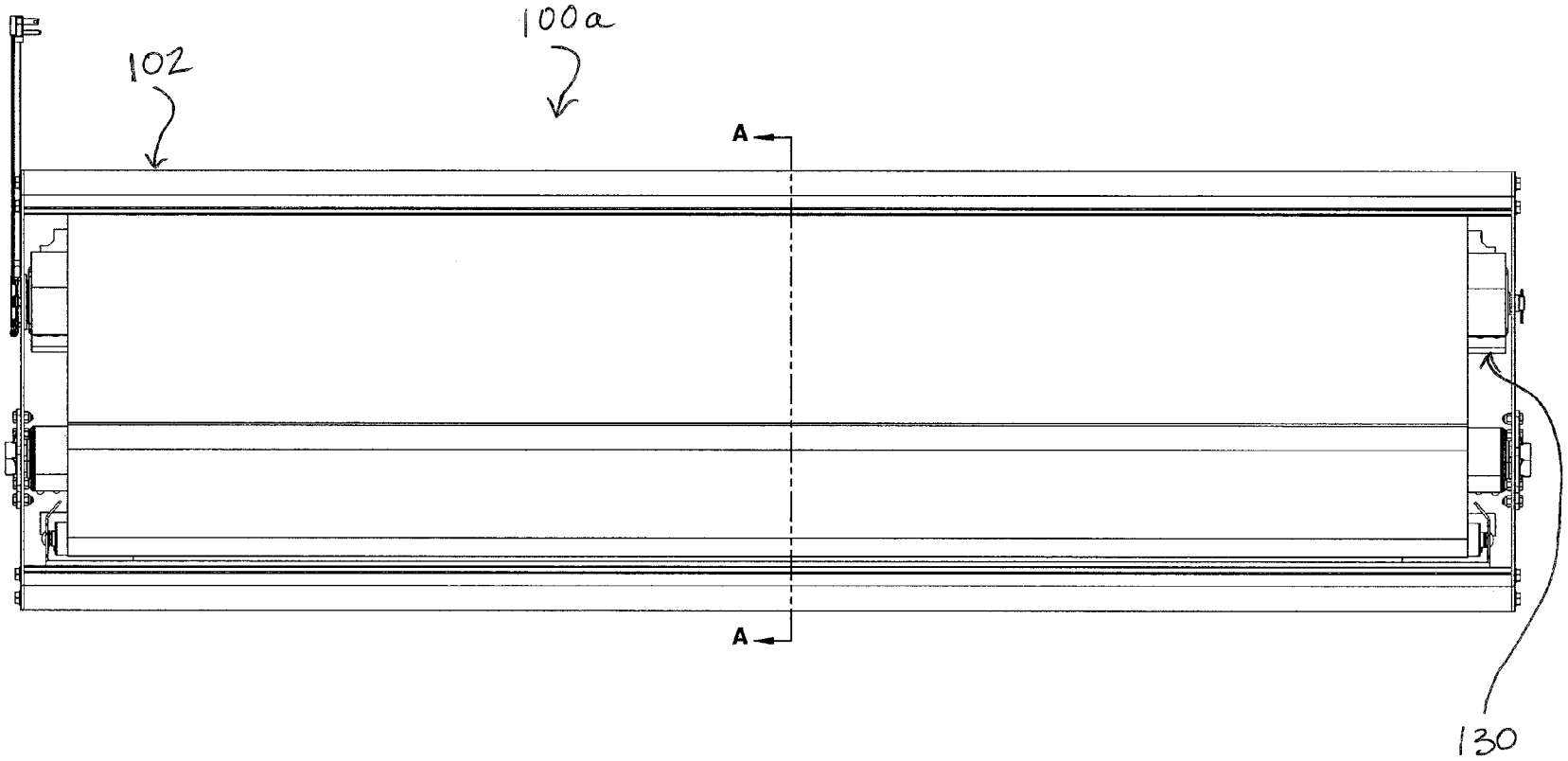
FIG. 3 is a side elevation view of the motorized acoustical banner of FIG. 1.
Figure 5:
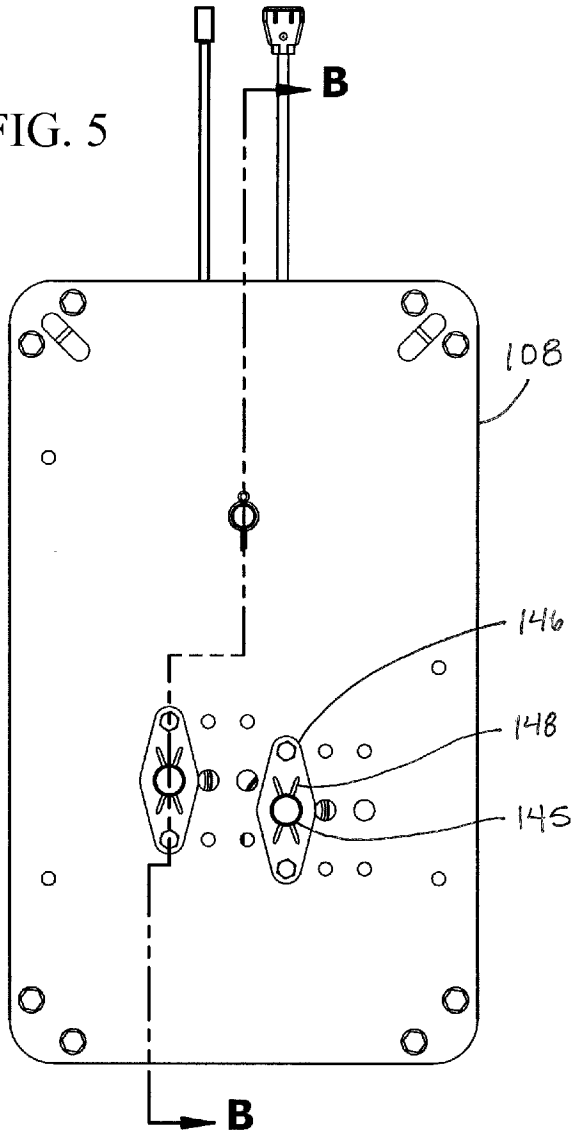
FIG. 5 is an end view of the idler end of the motorized acoustical banner of FIG. 1.
Figure 4:
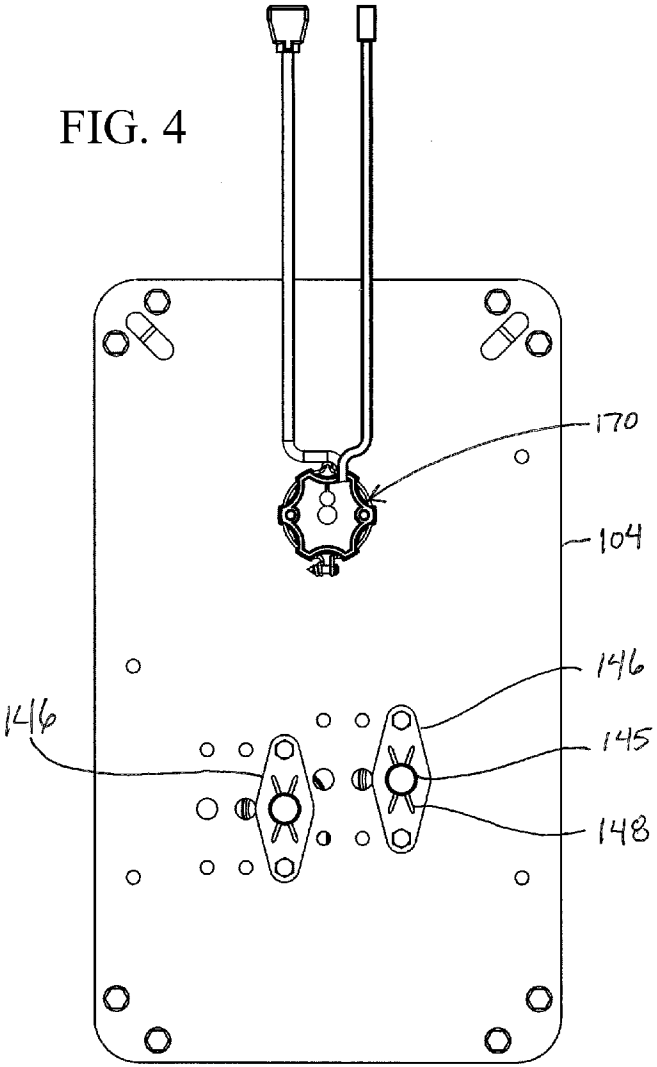
FIG. 4 is an end view of the motor end of the motorized acoustical banner of FIG. 1.
Figure 7:
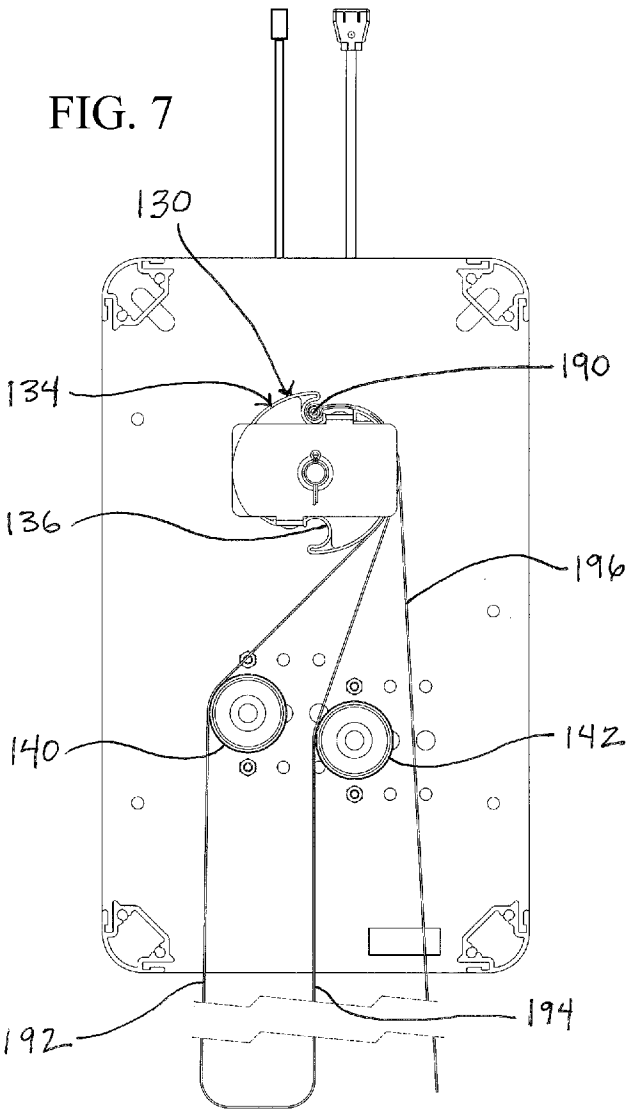
FIG. 7 is a detail view looking toward the motor end of the motorized acoustical banner of FIG. 1, depicting the routing of the banner around the rollers.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

The following detailed description should be read with reference to the drawings in which similar elements in different drawings are numbered the same. The drawings, which are not necessarily to scale, depict illustrative embodiments and are not intended to limit the scope of the invention.

The accompanying Figures depict embodiments of the mount of the present invention, and features and components thereof. Any references to front and back, right and left, top and bottom, upper and lower, and horizontal and vertical are intended for convenience of description, not to limit the present invention or its components to any one positional or spatial orientation. Any dimensions specified in the attached Figures and this specification may vary with a potential design and the intended use of an embodiment of the invention without departing from the scope of the invention.

Referring generally to the Figures, embodiments of the present invention include a motorized acoustical banner assembly 100 having a housing 102, a drum roller 130, a plurality of idler rollers, a tubular motor 170, a banner 180 and optionally a plurality of decorative covers.

Referring now to FIGS. 1-14, a motorized acoustical banner assembly 100*a* is depicted according to an embodiment of the invention. Housing 102 includes a motor end plate 104 having a plurality of roller positioning bores 106, an idler end plate 108 having a plurality of roller positioning bores 110, top mounting plates 112, and frame rails 116. Housing 102 further includes a number of decorative covers or closures, including front cover 120, rear cover 122, top cover 124 and end covers 126 as best depicted in FIG. 1.

Within housing 102 are a plurality of rollers. Drum roller 130 is configured to receive banner 180, and generally includes an inner bore 132 and an outer profile 134 including a channel 136 configured to couple with banner 180 as described in greater detail below. A first or front idler roller 140 and a second or rear idler roller 142 are provided for routing banner 180 as desired. Each idler roller is slidingly received on a shaft 145, with shaft 145 secured in brackets 146 via clips, pins or other means 148. The positions of front idler roller 140 and rear idler roller 142 may be adjusted in order to adjust the spacing between the front and rear portions of banner 180 and also adjust the spacing between banner 180 and a nearby wall. As best depicted in FIGS. 4, 5, 9 and 10, each of motor end plate 104 and idler end plate 108 include a number of positioning holes 106 and 110 for mounting idler rollers thereto. Idler roller 140 is mounted via one of positioning holes 106*a*, 106*b*, or 106*c*, while idler roller 142 is mounted via one of positioning holes 110*a*, 110*b*, or 110*c*. By varying the mounting position of idler rollers 140, 142, the spacing of banner 180 may be adjusted as depicted in FIG. 25A.

Figure 6:
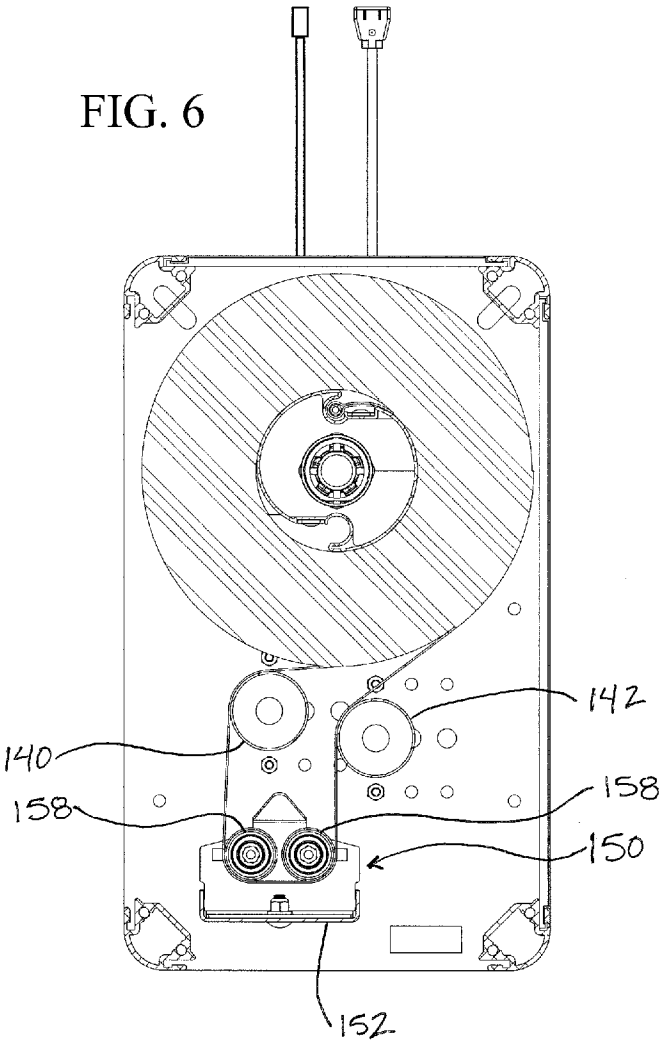
FIG. 6 is a cross-sectional view taken along the line A-A in FIG. 3.
Figure 8:
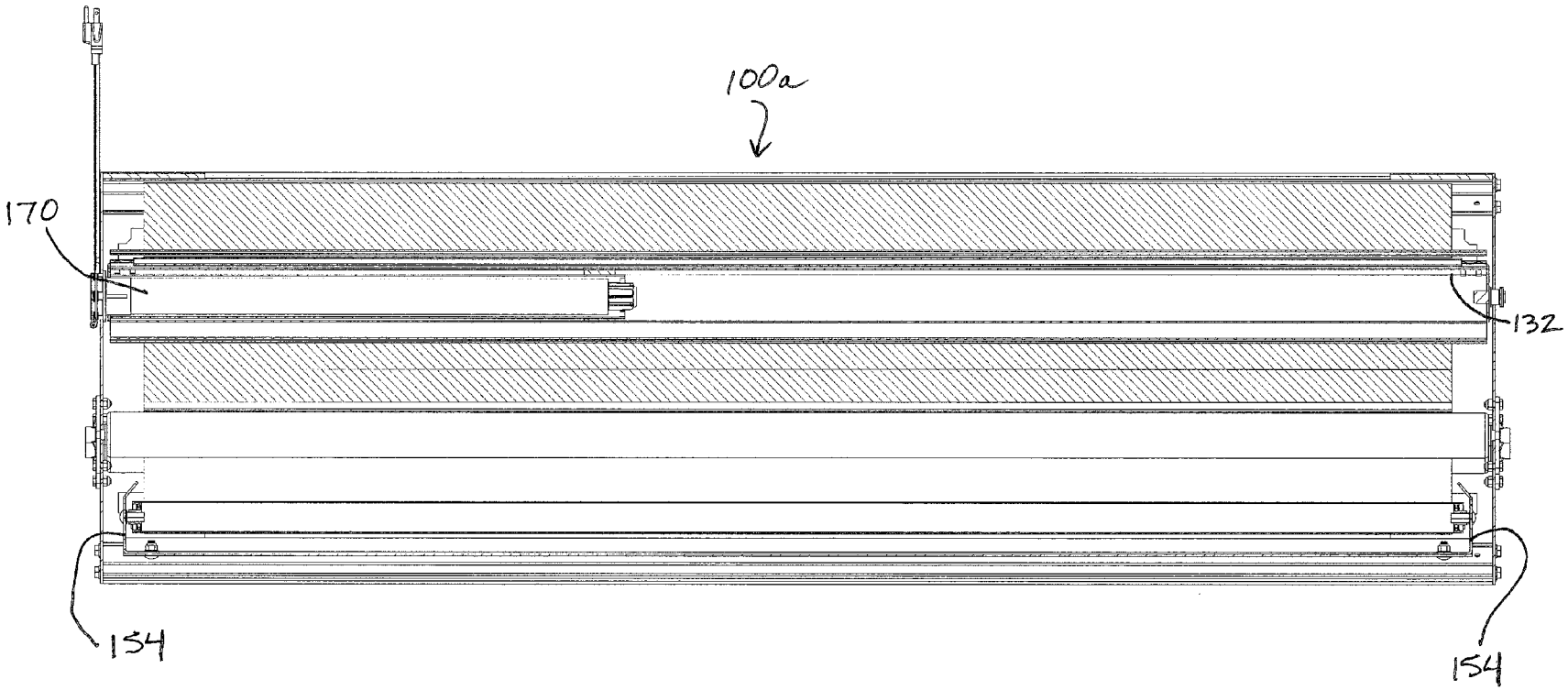
FIG. 8 is a cross-sectional view taken along the line B-B in FIG. 5.
Figures 9, 10:
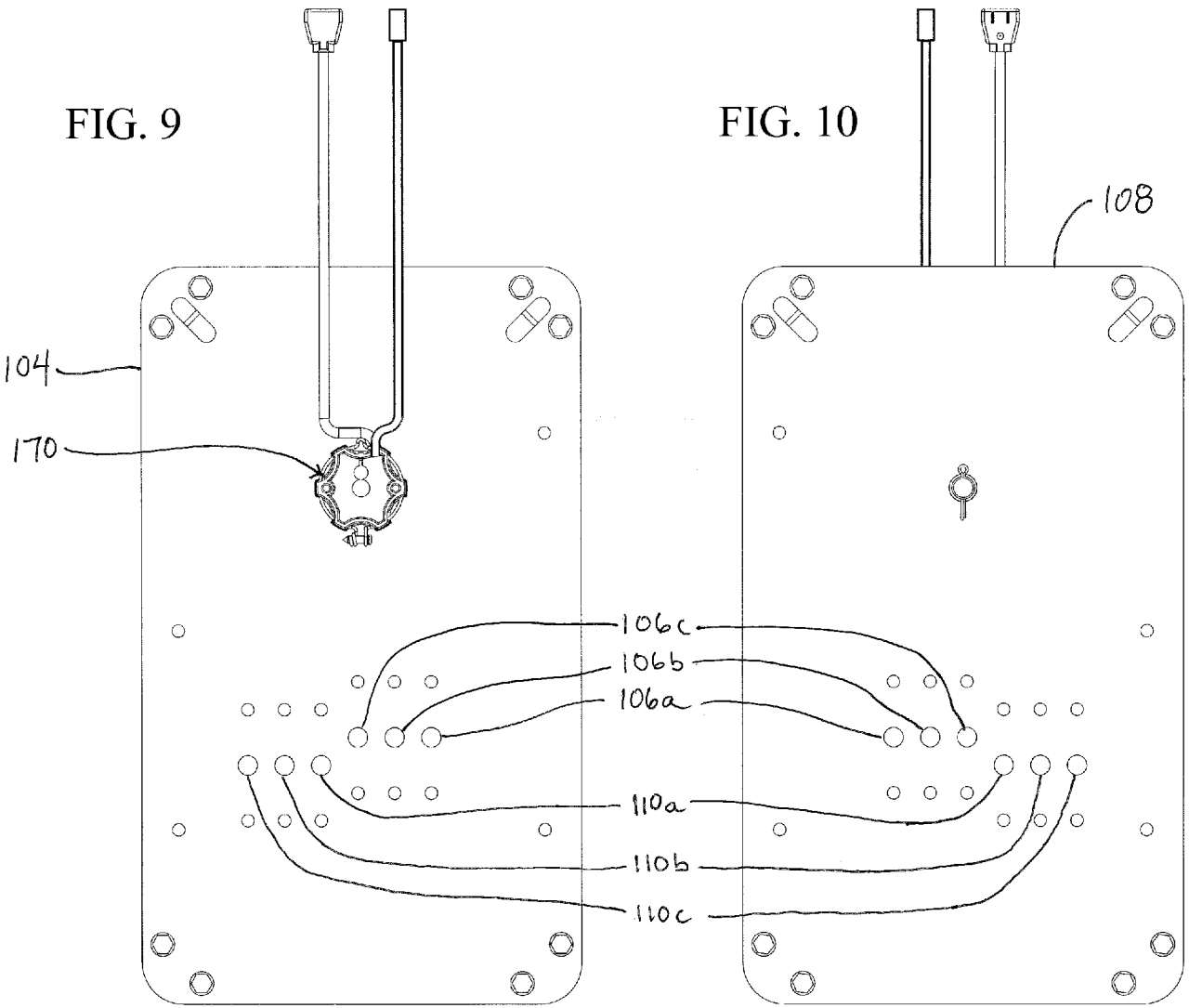
FIG. 9 is an end view of the motor end of the motorized acoustical banner of FIG. 1, with the idler rollers removed.
FIG. 10 is an end view of the idler end of the motorized acoustical banner of FIG. 1, with the idler rollers removed.
Figure 11:
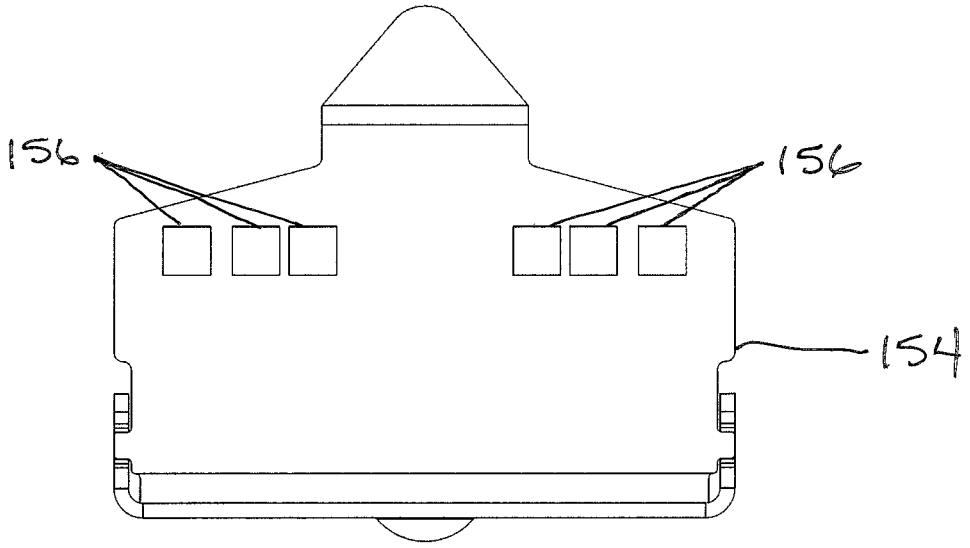
FIG. 11 is an end view of a batten assembly for use with the motorized acoustical banner of FIG. 1.

A batten assembly 150 is also provided as part of motorized acoustical banner assembly 100*a*. Batten assembly 150 generally includes a bottom bracket 152, a plurality of end brackets 154 each having a plurality of roller positioning holes 156, and a plurality of rollers 158 coupled between end brackets 154. The spacing of rollers 158 should be adjusted using roller positioning holes 156 to mimic the spacing of idler rollers 140, 142. Banner 180 is routed around rollers 158 as depicted in FIG. 6. In operation, batten assembly 150 functions to maintain the bottom of banner 180 level, to maintain proper spacing between banner 180 and a nearby wall, and to maintain proper spacing between a front portion 192 and a rear portion 194 of banner 180.

Figure 24B:
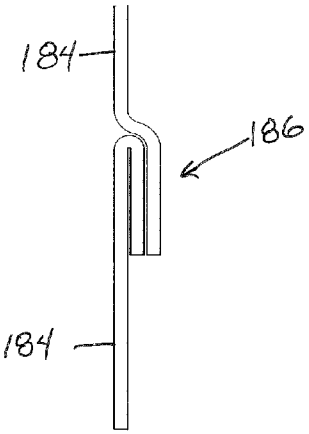
FIG. 24B depicts the stitching pattern of a plurality of panels of the banner of FIG. 24A.
Figure 24A:
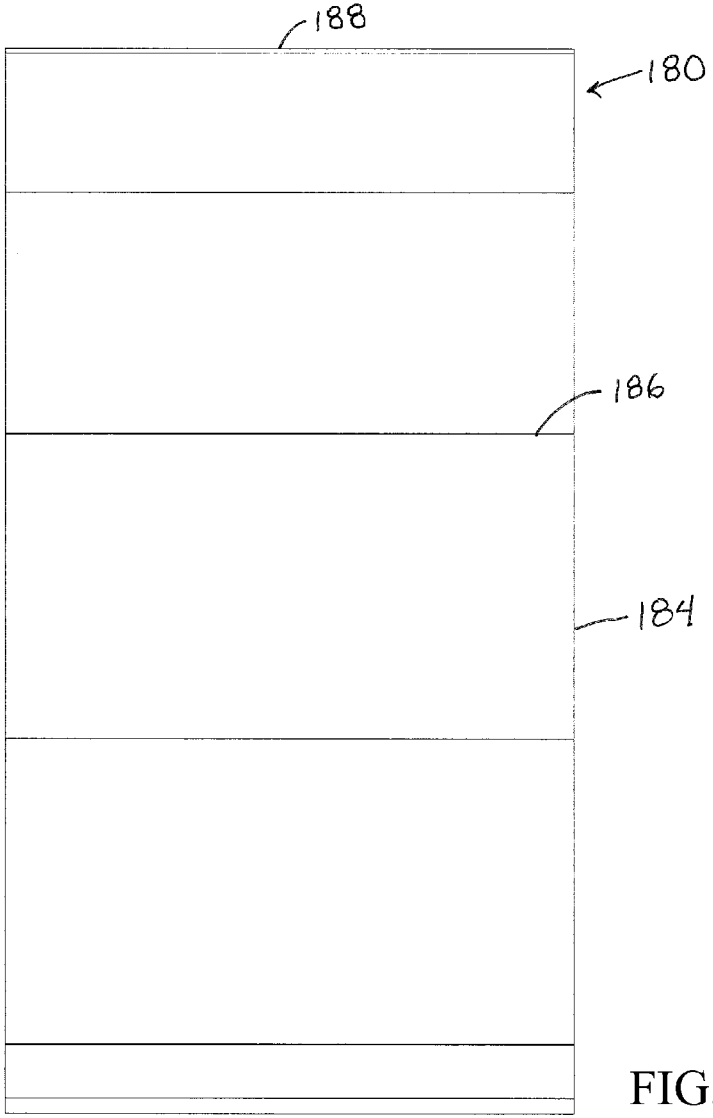
FIG. 24A depicts a banner according to an embodiment of the present invention.

Referring now to FIGS. 24A-24B, banner 180 for embodiments of the invention generally comprises a loop constructed of a fabric portion 182 including a plurality of panels 184 joined at seams 186, a hem loop portion 188 configured to receive a rod or spline 190 therethrough, and an alignment flap 196. With rod 190 positioned within hem loop portion 188, banner 180 may be coupled to drum roller 130 by securing rod 190 in channel 136 of drum roller 130. Banner 180 may then be wound around drum roller 130 by rotating drum roller 130. When deployed in an operable position, banner 180 presents a front viewable portion 192 oriented toward a source of sound and a rear portion 194 oriented toward a nearby wall or other structure.

Figure 12:
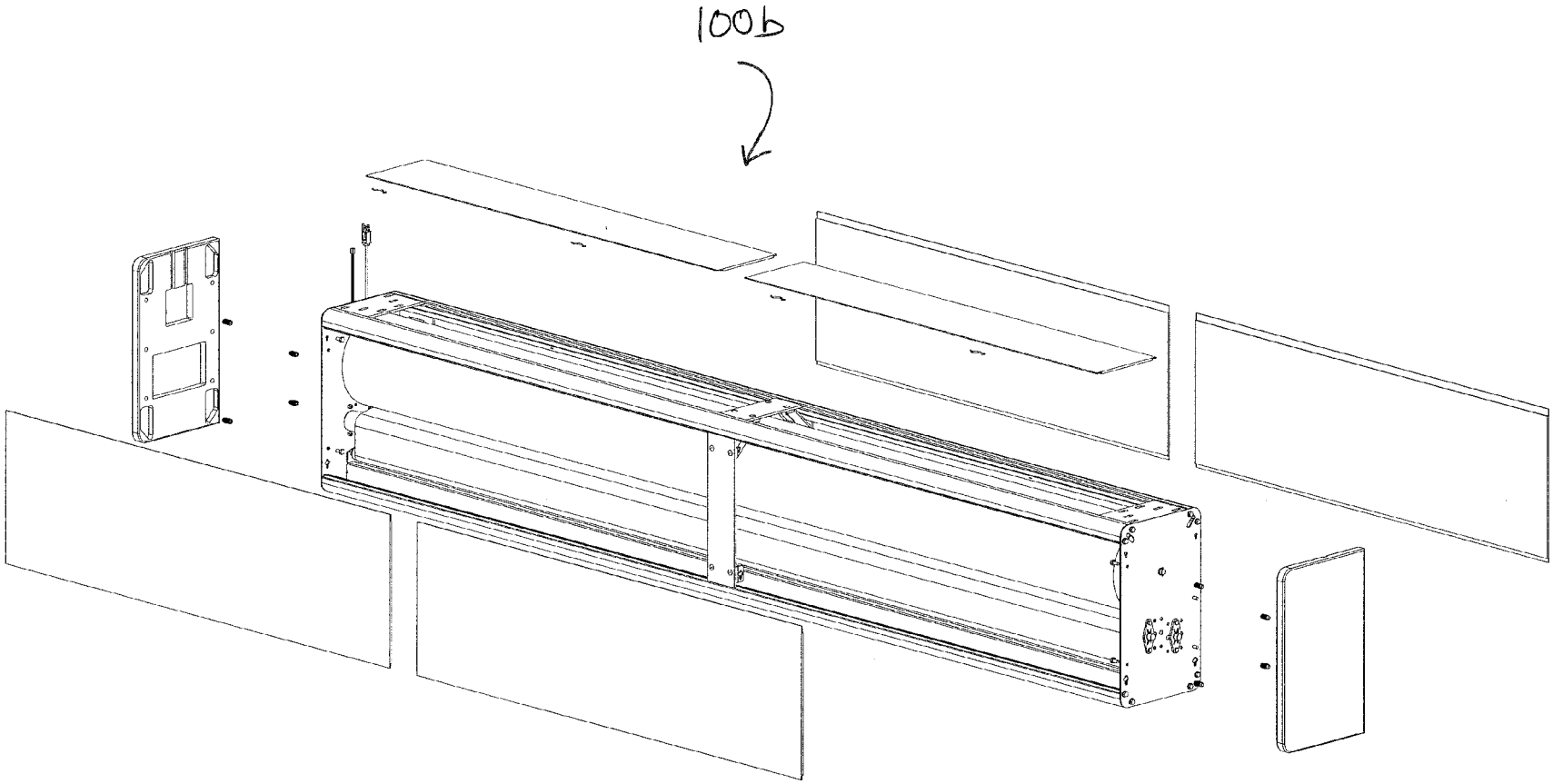
FIG. 12 is a partially exploded dimetric projection view of a motorized acoustical banner including cosmetic covers, according to another embodiment of the invention.
Figure 13:
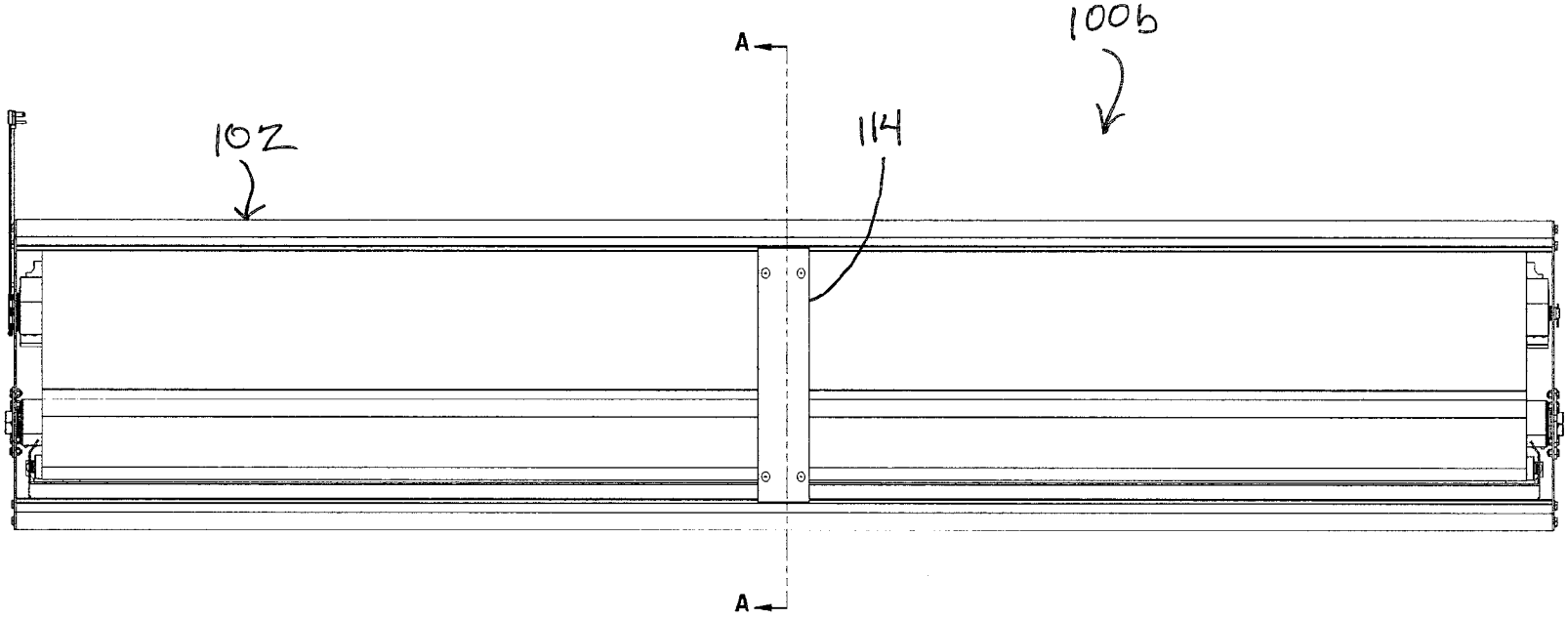
FIG. 13 is a side elevation view of the motorized acoustical banner of FIG. 12.
Figure 14:
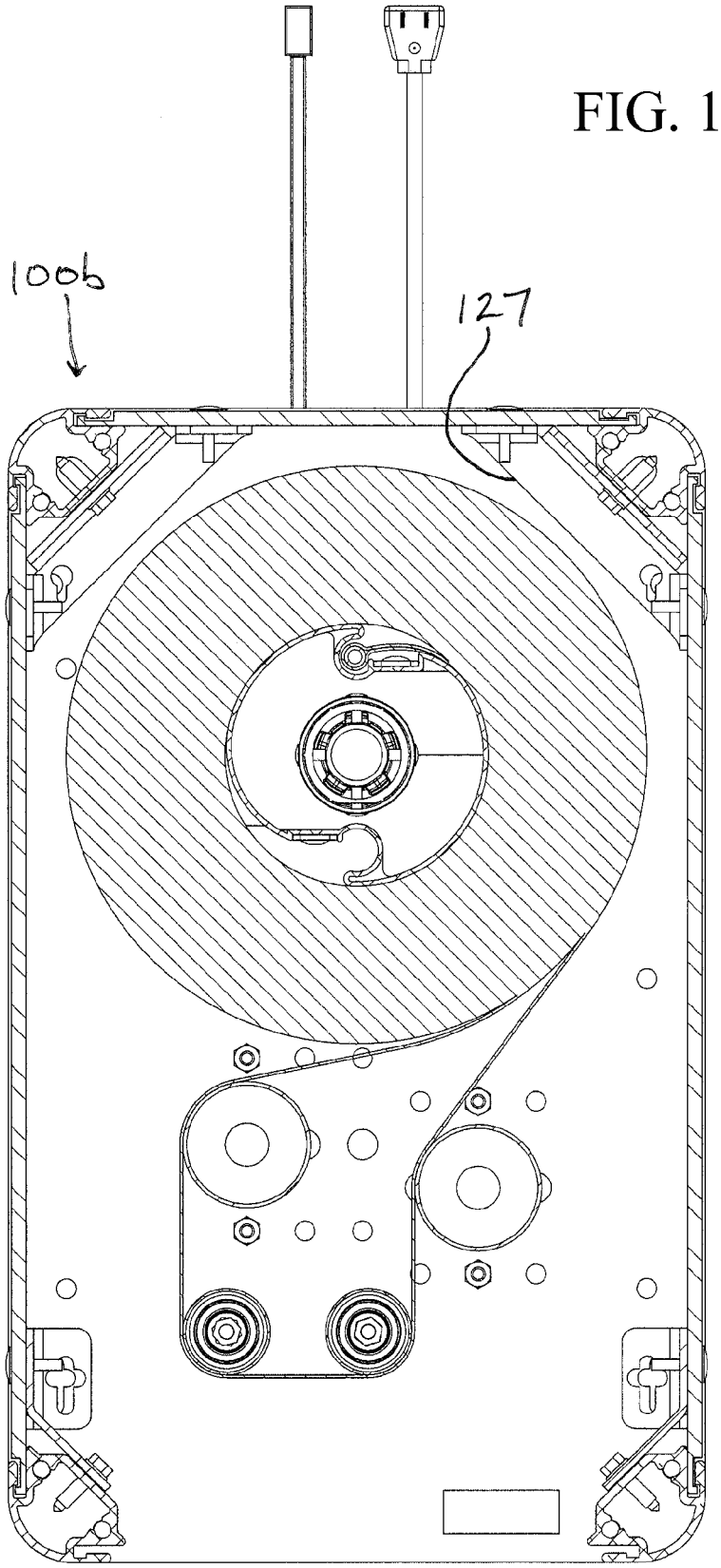
FIG. 14 is a cross-sectional view taken along the line A-A in FIG. 13.
Figure 15:
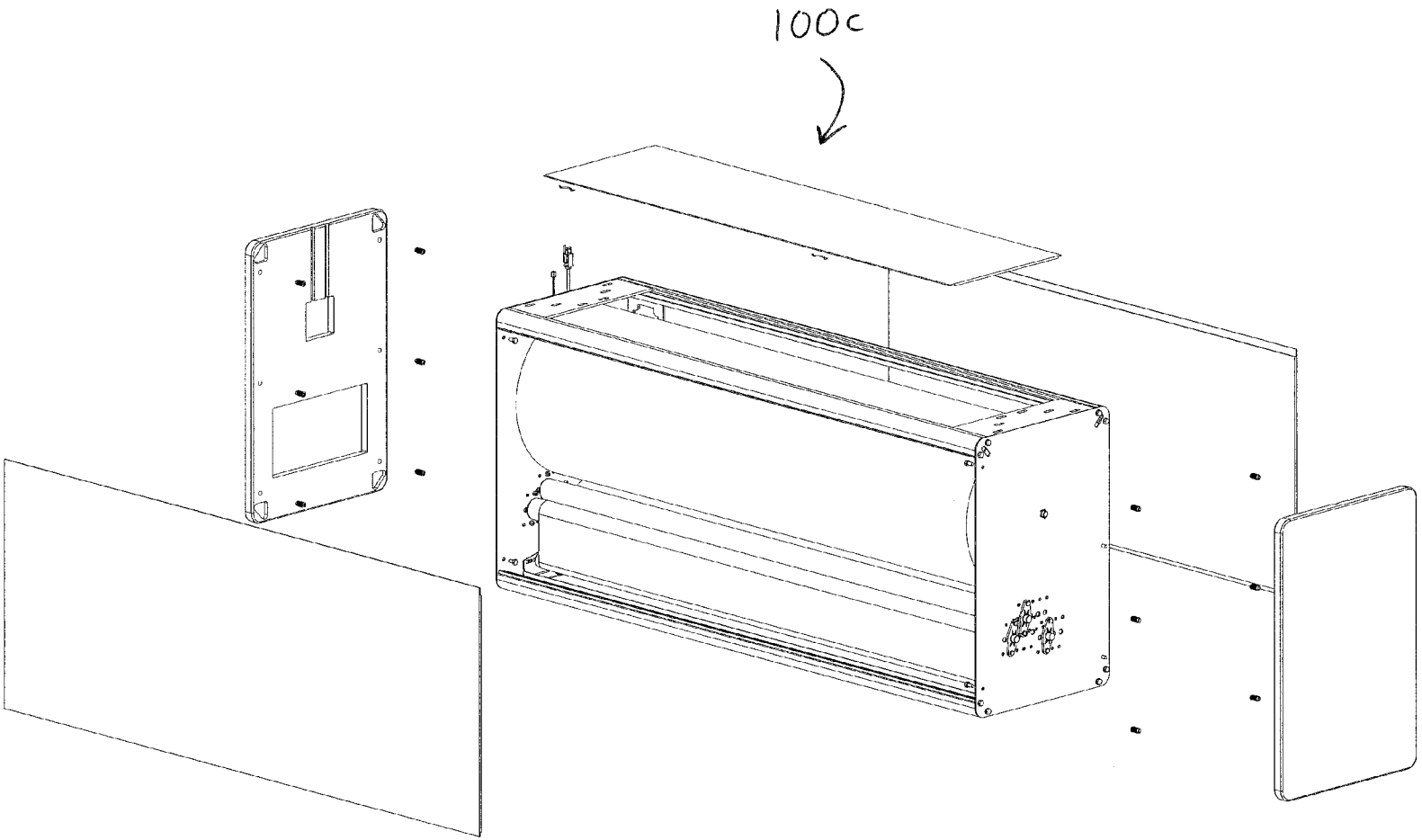
FIG. 15 is a partially exploded dimetric projection view of a motorized acoustical banner including cosmetic covers, according to another embodiment of the invention.
Figure 16:
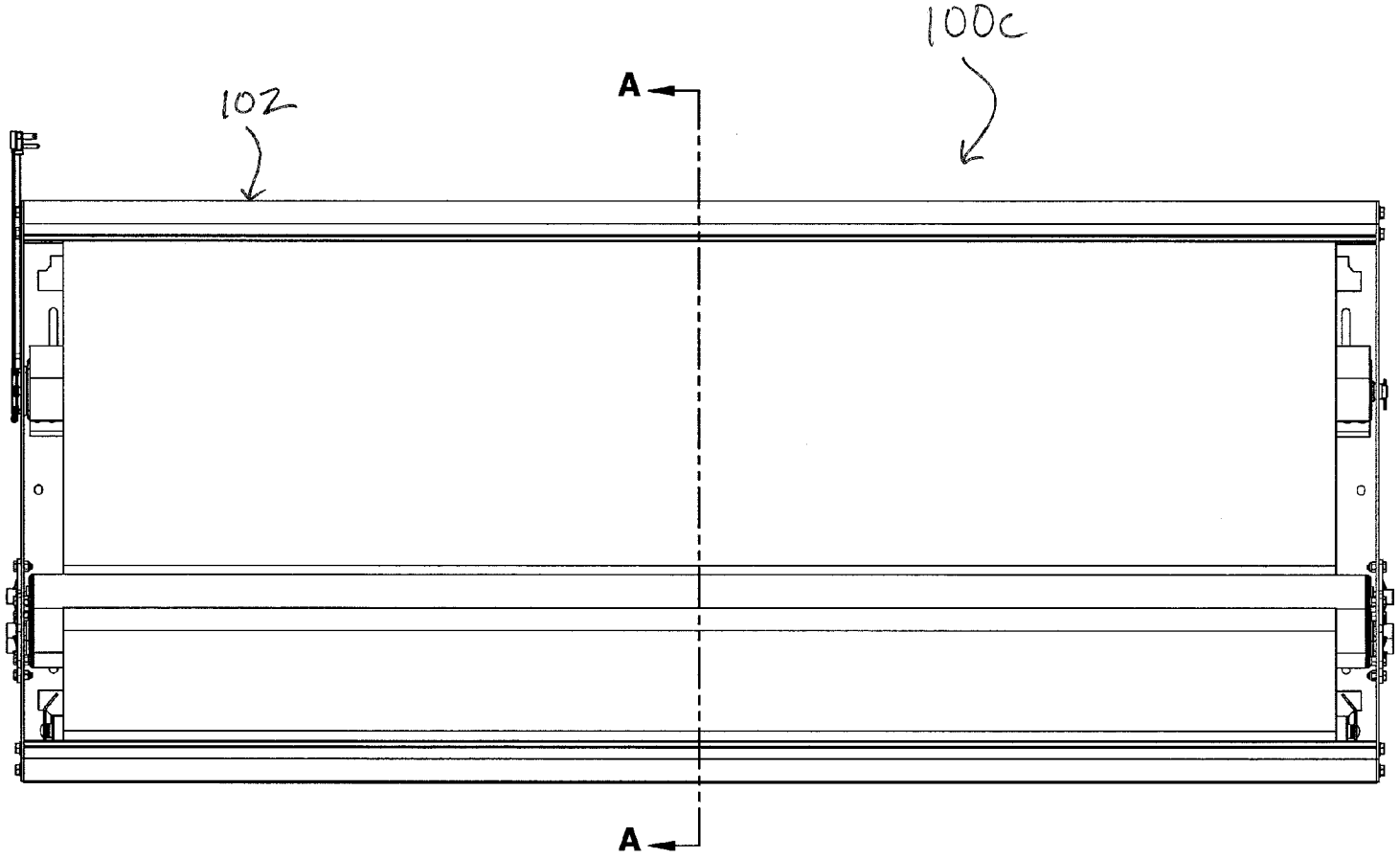
FIG. 16 is a side elevation view of the motorized acoustical banner of FIG. 15.
Figure 18:
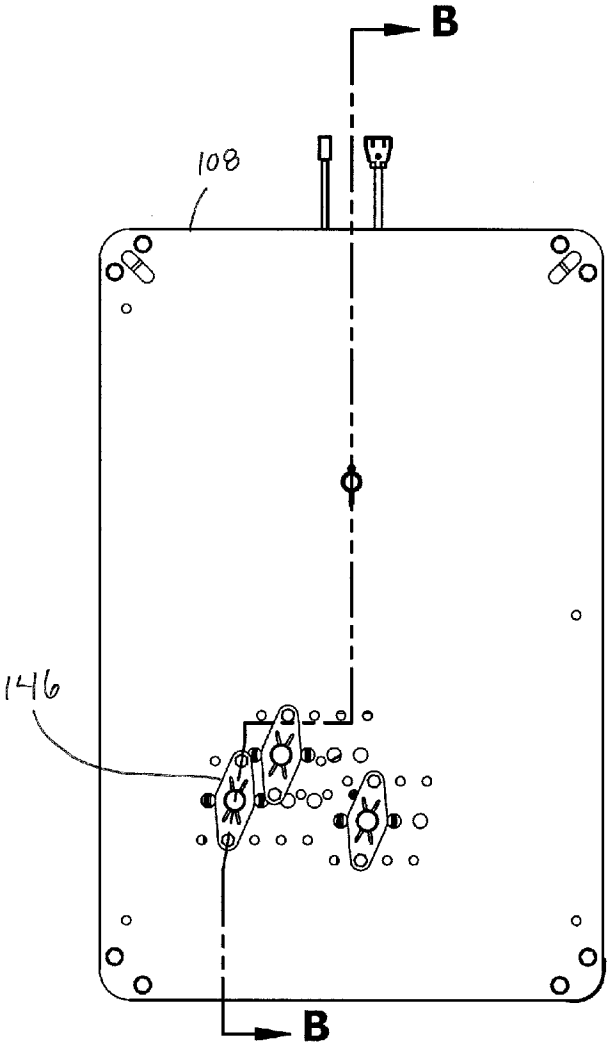
FIG. 18 is an end view of the idler end of the motorized acoustical banner of FIG. 15.
Figure 17:
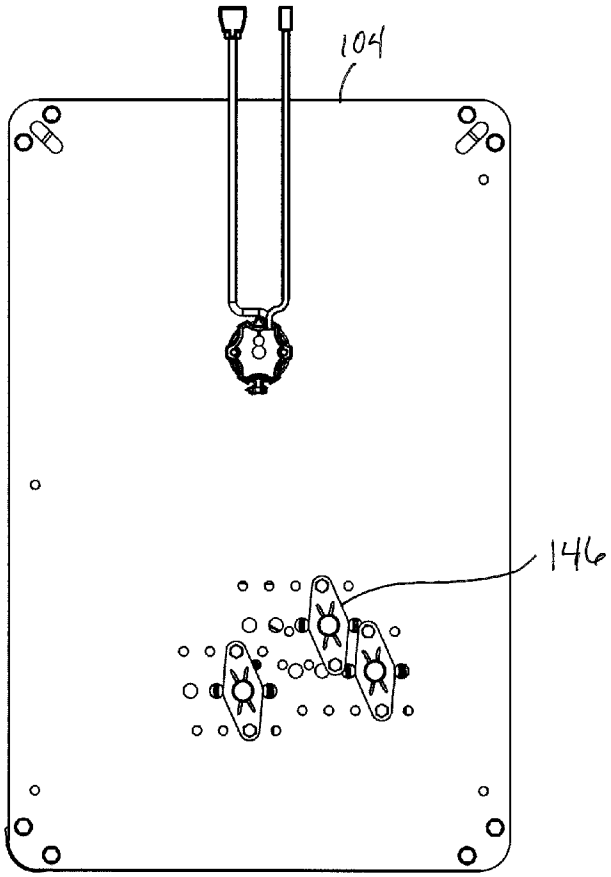
FIG. 17 is an end view of the motor end of the motorized acoustical banner of FIG. 15.
Figure 20:
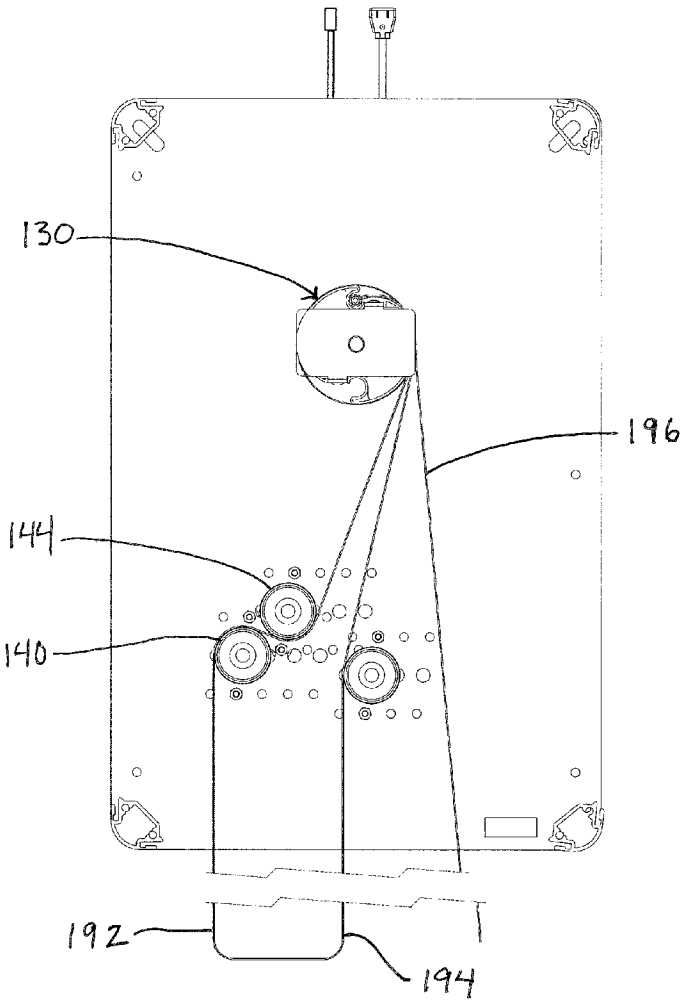
FIG. 20 is a detail view looking toward the motor end of the motorized acoustical banner of FIG. 15, depicting the routing of the banner around the rollers.
Figure 19:
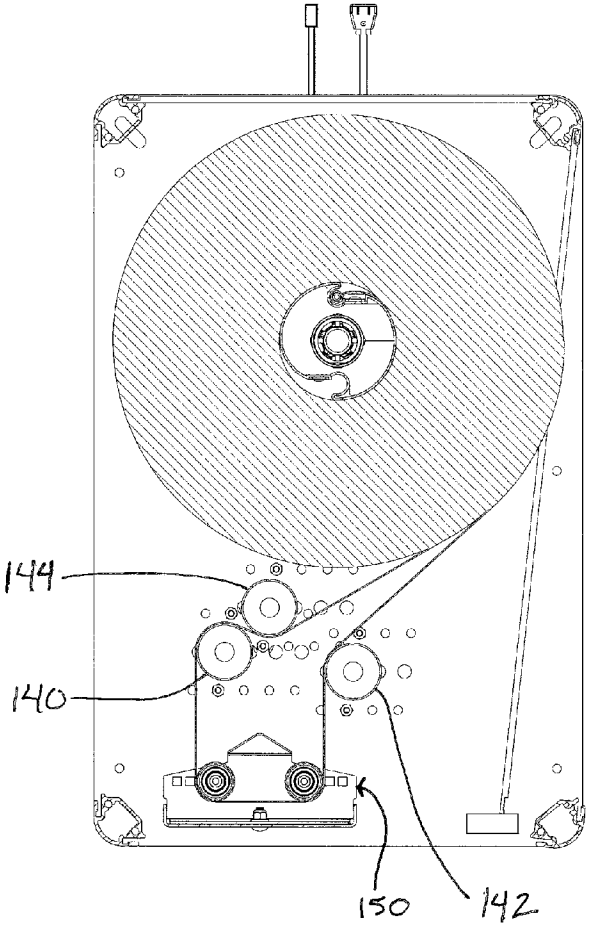
FIG. 19 is a cross-sectional view taken along the line A-A in FIG. 16.

Referring now to FIGS. 12-14, another embodiment of the present invention is depicted. Motorized acoustical banner 100*b* is identical to motorized acoustical banner 100*a*, except as noted otherwise. Motorized acoustical banner 100*b* is of greater width than motorized acoustical banner 100*a*, and as such housing 102 includes a plurality of braces or plates 114 as depicted in FIGS. 12-13. Additionally, housing 102 includes a plurality of bracing brackets 127 as best depicted in FIG. 14.

Figure 23:
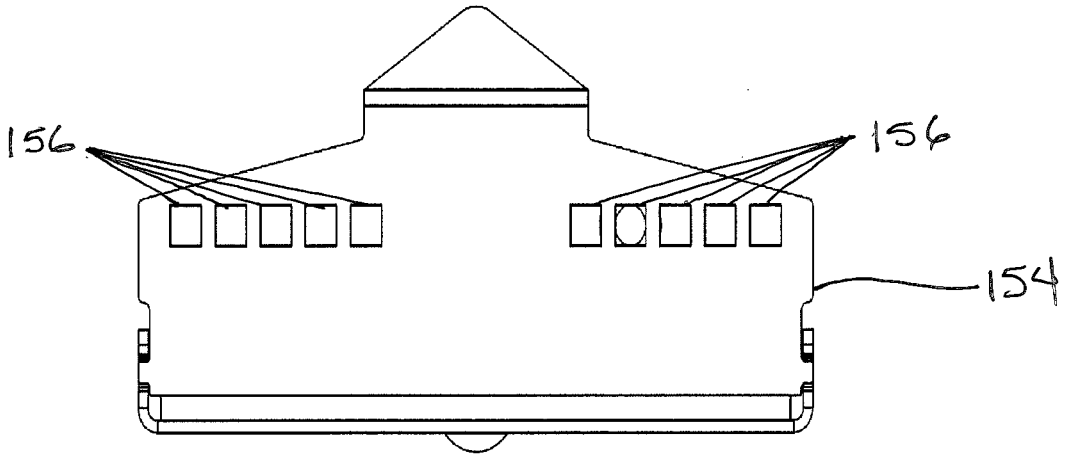
FIG. 23 is an end view of a batten assembly for use with the motorized acoustical banner of FIG. 15.
Figure 22:
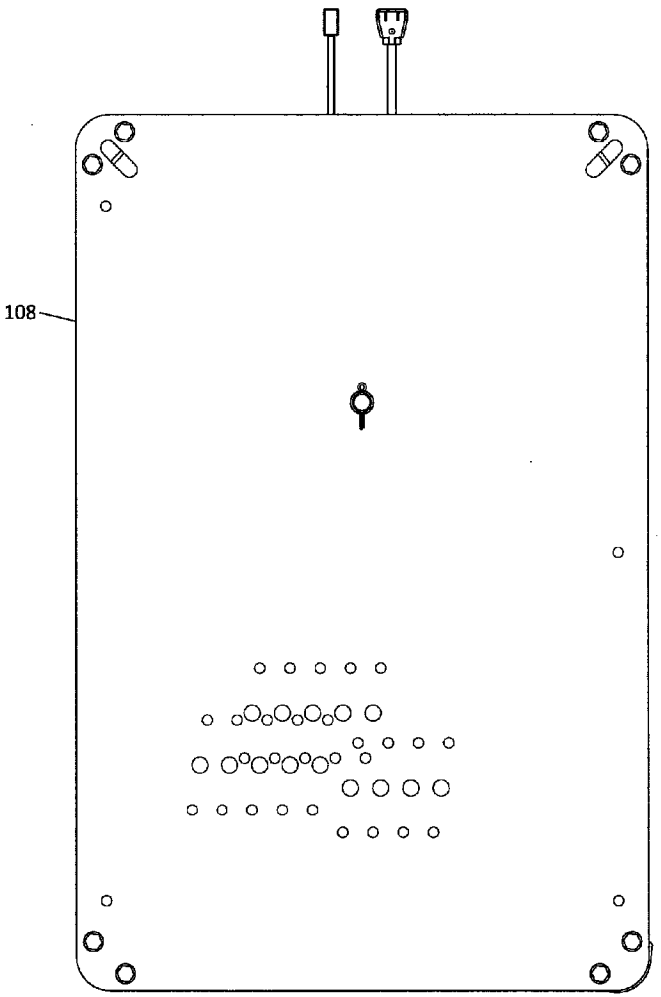
FIG. 22 is an end view of the idler end of the motorized acoustical banner of FIG. 15, with the idler rollers removed.
Figure 21:
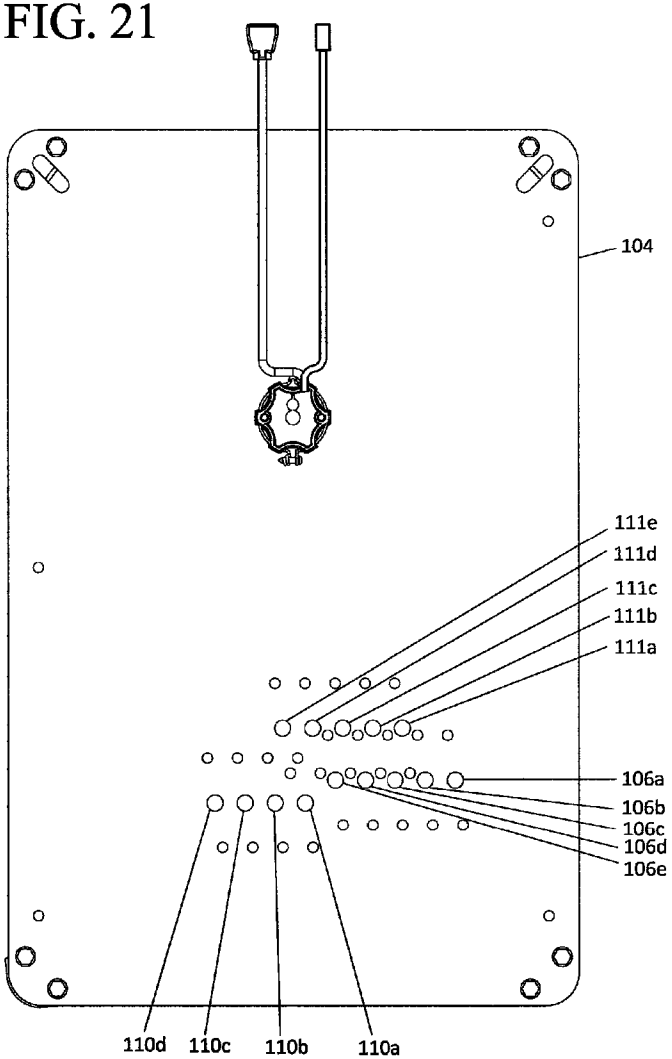
FIG. 21 is an end view of the motor end of the motorized acoustical banner of FIG. 15, with the idler rollers removed.

Referring now to FIGS. 15-23, another embodiment of the present invention is depicted. Motorized acoustical banner 100*c* is identical to motorized acoustical banner 100*a*, except as noted otherwise. Motorized acoustical banner 100*c* is configured with a combination velour and PolyZorb banner 180. Because of the construction of the combination velour and PolyZorb banner 180, a third idler roller 144 is required to maintain positioning of the velour and PolyZorb layers. Further, each of motor end plate 104 and idler end plate 108 include additional roller positioning holes 111*a-e* as best depicted in FIGS. 22-23. The spacing of banner 180 in motorized acoustical banner 100*c* may be adjusted as depicted in FIG. 25B by varying the mounting position of idler rollers 140, 142, and 144 on end plates 104, 108 using respective roller positioning holes 106*a-e*, 110*a-d* and 111*a-e*.

Referring now to FIGS. 24A-24B, banner 180 for embodiments of the invention generally comprises a loop constructed of a fabric portion 182 including a plurality of panels 184 joined at seams 186, a hem loop portion 188 configured to receive a rod or spline 192 therethrough, and an alignment flap 196. With rod 192 positioned within hem loop portion 188, banner 180 may be coupled to drum roller 130 by securing rod 192 in channel 136 of drum roller 130. Banner 180 may then be wound around drum roller 130 by rotating drum roller 130. When deployed in an operable position, banner 180 presents a front viewable portion 192 oriented toward a source of sound and a rear portion 194 oriented toward a nearby wall or other structure.

Accurate tracking of banner 180 is critical to proper operation of motorized acoustical banner 100. Each motorized acoustical banner assembly 100 is adjusted prior to delivery to the end user for proper tracking, i.e., the ability of motorized acoustical banner 100 to position the fabric panels 184 of banner 180 directly on top of one another as drum roller 130 revolves and banner 180 rolls up into its stored position. Tracking not only affects the position of banner 180 but also affects the levelness of the bottom batten, an issue critical to appearance. The installation accuracy of banner 180, stretching of banner 180, variations in fabric manufacture and changes in temperature/humidity can all affect how well banner 180 tracks.

Each motorized acoustical banner assembly 100 includes sufficient room internally to allow banner 180 to track up to 2 inches to either side. Because tracking accuracy affects the levelness of the bottom batten, it is recommended that the tracking is adjusted to be within ½" of the nominal starting position. Because the tracking is customized for each individual motorized acoustical banner assembly 100, if banner 180 is removed for cleaning (or any other reason) and is to be reused, it is best to reinstall it on the same mechanism from which it was removed. This will minimize or possibly eliminate any necessary tracking adjustments.

However, if adjustment of the tracking becomes necessary over time or due to removal/replacement of banner 180, the following procedure should be performed. Operate banner 180 through its full range from down to up. When fully rolled up on drum roller 130, inspect the roll of banner 180 and determine approximately how much banner 180 tracked from side to side throughout its total travel. If the tracking variation is greater than ½" toward either side, adjustment is recommended. Lower banner 180 beyond its lowest normal operating position until adjustment/alignment flap 196 is exposed in front of the main front fabric panel 184. This flap 196 will be cut as necessary to create a taper that will effectively change the diameter of the roll from one side to the other. This difference will change how banner 180 tracks.

In operation, motorized acoustical banner 100 is movable between a retracted position and a deployed position. In the retracted position, banner 180 and batten assembly 150 are fully concealed within housing 102 so as to present an aesthetically pleasing appearance. In deployed positions, banner 180 is lowered out of housing 102 to a desired height in order to control levels of sound absorption in a performance space as desired. The height of banner 180 in the deployed position is nearly infinitely variably adjustable via motor 170.

In order to alter the acoustic characteristics of a performance space in which motorized acoustical banner 100 is installed, a number of adjustments may be made. Firstly, the deployment height of banner 180 may be adjusted. Secondly, the spacing between banner 180 and a nearby wall may be adjusted. Additionally, the spacing between front portion 192 and rear portion 194 of banner 180 may be adjusted. To perform spacing adjustments on banner 180, clip 148 is removed from shaft 145, allowing shaft 145 to be removed from housing 102. Brackets 142 are moved to the desired positioning holes according to FIGS. 26A and 26B. Idler rollers are repositioned as necessary, shafts 145 are reintroduced to couple the idler rollers to end plates 104 and 108 and clips 148 are reinstalled. Finally, a variety of materials may be used for banner 180 to provide differing acoustical characteristics.

A variety of materials may be used to construct the various components of the invention. For example, the various rollers and housing components may be constructed from steel, aluminum or other alloys, or suitable polymers. The various covers may be constructed from laminated particle board, wood, aluminum or other alloys, or suitable polymers or composites. The banner material may comprise double layer encore velour, double layer wool serge, single layer PolyZorb quilted fabric with single layer wool, or single layer PolyZorb with single layer velour. The above list of material selections should be considered exemplary and not in any way limiting, and other suitable materials will be apparent to persons skilled in the art.

With regard to the above detailed description, like reference numerals used therein may refer to like elements that may have the same or similar dimensions, materials, and configurations. While particular forms of embodiments have been illustrated and described, it will be apparent that various modifications can be made without departing from the spirit and scope of the embodiments herein. Accordingly, it is not intended that the invention be limited by the forgoing detailed description.

Various modifications to the embodiments of the inventions may be apparent to one of skill in the art upon reading this disclosure. For example, persons of ordinary skill in the relevant art will recognize that the various features described for the different embodiments of the inventions can be suitably combined, un-combined, and re-combined with other features, alone, or in different combinations, within the spirit of the invention. Likewise, the various features described above should all be regarded as example embodiments, rather than limitations to the scope or spirit of the inventions. Therefore, the above is not contemplated to limit the scope of the present inventions.

Persons of ordinary skill in the relevant arts will recognize that the inventions may comprise fewer features than illustrated in any individual embodiment described above. The embodiments described herein are not meant to be an exhaustive presentation of the ways in which the various features of the inventions may be combined. Accordingly, the embodiments are not mutually exclusive combinations of features; rather, the inventions may comprise a combination of different individual features selected from different individual embodiments, as understood by persons of ordinary skill in the art.

The invention claimed is:

1. An acoustical banner system, comprising:

a housing;

a drum roller operably coupled to the housing, the drum roller including at least one lengthwise channel;

a banner having a front portion and a rear portion;

a rod coupleable to an end of the banner, the banner being coupleable to the drum roller by securing the rod into the channel, the banner configured to be wound around the drum roller in a roll;

a plurality of idler rollers operably coupled to the housing, the banner being routed around the idler rollers such that the front portion of the banner is separated from the rear portion of the banner by a predetermined distance based on the locations of the idler rollers; and a motor operably coupled to the drum roller, the banner being movable via the motor between a retracted position wherein the banner is concealed within the housing and a deployed position wherein at least a portion of the banner hangs below the housing.

2. The system of claim 1, wherein the banner is constructed from a plurality of panels joined together.

3. The system of claim 1, wherein the housing includes a plurality of mounting positions for each of the idler rollers such that altering the mounting position of at least one of the idler rollers alters at least one of the spacing of the banner from a nearby surface and the spacing between the front and rear portions of the banner.

4. The system of claim 1, further comprising a batten assembly having at least two batten rollers, the banner being routed around the two batten rollers.

5. The system of claim 4, wherein the spacing between the batten rollers is adjustable.

6. The system of claim 5, wherein the front and rear portions of the banner hanging below the housing in the deployed position are generally parallel to one another.

7. The system of claim 1, wherein the motor is received within an inner bore of the drum roller.

8. The system of claim 1, wherein the banner is further routed such that the front portion of the banner extends directly from the roll to one of the idler rollers and the second portion of the banner extends directly from the roll to the other of the idler rollers.

9. The system of claim 1, wherein the banner is further constructed to form a loop, the front and rear portions of the banner being part of the loop.

10. The system of claim 1, further comprising a third idler roller operably coupled to the housing.

11. A method, comprising:

causing a motorized acoustical banner to be manufactured, the motorized acoustical banner including a housing, a banner, a rod coupleable to an end of the banner, a drum roller operably coupled to the housing, a plurality of idler rollers operably coupled to the housing, and a motor operably coupled to the drum roller;

coupling the banner to the drum by securing the rod into a lengthwise channel of the drum;

orienting the banner around the idler rollers such that a front portion of the banner is separated from a rear portion of the banner by a predetermined distance based on the distance between the idler rollers;

winding the banner around the drum roller;

operating the motorized acoustical banner to move the banner between a retracted position wherein the banner is concealed within the housing and a deployed position wherein at least a portion of the banner hangs below the housing.

12. The method of claim 11, further comprising:

adjusting the distance between the front and rear portions of the banner by moving at least one of the idler rollers to a different mounting position on the housing.

13. The method of claim 11, further comprising:

adjusting the distance between the rear portion of the banner and a nearby surface by moving at least one of the idler rollers to a different mounting position on the housing.

14. The method of claim 11, further comprising:

orienting the banner around a batten assembly, the batten assembly including two adjustably positionable batten rollers.

15. An acoustical banner system, comprising:

a housing;

a banner, having a rod coupled to an end of the banner;

a drum roller coupled to the housing and having at least one lengthwise channel, the banner being windably received on the drum roller and coupleable thereto by securing the rod into the channel;

a plurality of idler rollers, selectively positionably coupled to the housing; and a motor operably coupled to the drum roller, the motor configured to rotate the drum roller and thereby wind and unwind the banner from the drum roller, wherein the banner is routed around the idler rollers such that a front portion of the banner is separated from a rear portion of the banner by a distance determined by the positions of the idler rollers.

16. The acoustical banner system of claim 15, the banner being movable via the motor between a retracted position wherein the banner is substantially wound around the drum roller and concealed within the housing, and a deployed position wherein the banner is at least partly unwound from the retracted position and at least a portion of the banner hangs below the housing.

17. The system of claim 15, wherein the housing includes a plurality of mounting positions for selectively positionably coupling each of the idler rollers such that altering the mounting position of at least one of the idler rollers alters at least one of the spacing of the banner from a nearby surface and the spacing between the front and rear portions of the banner.

18. The system of claim 15, wherein the banner is further routed such that the front portion of the banner extends directly from the drum roller to one of the idler rollers and the second portion of the banner extends directly from the drum roller to the other of the idler rollers.

19. The system of claim 15, further comprising a batten assembly having at least two adjustably positionable batten rollers, the banner being routed around the two batten rollers.

20. The system of claim 19, wherein the front and rear portions of the banner hanging below the housing in the deployed position are generally parallel to one another.

* * * * *